US009732749B2

(12) United States Patent
Krampe

(10) Patent No.: US 9,732,749 B2
(45) Date of Patent: Aug. 15, 2017

(54) ROTARY PISTON PUMP HAVING CONVERGING INLET AND OUTLET OPENINGS FOR CONVEYING A FLUID MEDIUM CONTAINING SOLIDS

(75) Inventor: Paul Krampe, Essen/Olbg (DE)

(73) Assignee: Hugo Vogelsang Maschinenbau GmbH, Essen (DE)

( * ) Notice: Subject to any disclaimer, the term of this patent is extended or adjusted under 35 U.S.C. 154(b) by 0 days.

(21) Appl. No.: 13/391,683

(22) PCT Filed: Sep. 8, 2010

(86) PCT No.: PCT/EP2010/063179

§ 371 (c)(1),
(2), (4) Date: Apr. 30, 2012

(87) PCT Pub. No.: WO2011/029847

PCT Pub. Date: Mar. 17, 2011

(65) Prior Publication Data

US 2012/0207638 A1 Aug. 16, 2012

(30) Foreign Application Priority Data

Sep. 8, 2009 (DE) ..... 20 2009 012 158 U

(51) Int. Cl.

| | |
|---|---|
| ***F04C 2/12*** | (2006.01) |
| ***F04C 2/08*** | (2006.01) |
| ***F04C 13/00*** | (2006.01) |

(52) U.S. Cl.

CPC ..... *F04C 2/126* (2013.01); *F04C 2/086* (2013.01); *F04C 13/001* (2013.01); *F04C 2210/24* (2013.01); *F04C 2250/102* (2013.01)

(58) Field of Classification Search

CPC ..... F04C 18/126; F04C 2250/102; F04C 29/0035; F04C 29/12; F04C 2/086; F04C 2250/10; F04C 2250/101; F01C 1/126; F01C 1/14; F01C 1/18; F01C 1/24; B01D 1/00

(Continued)

(56) References Cited

U.S. PATENT DOCUMENTS

| | | | |
|---|---|---|---|
| 1,972,565 | A | 9/1934 | Kempton |
| 2,096,490 | A | 10/1937 | Hansen |

(Continued)

FOREIGN PATENT DOCUMENTS

| | | | |
|---|---|---|---|
| CN | 2348151 | Y | 11/1999 |
| CN | 200946568 | Y | 9/2007 |

(Continued)

OTHER PUBLICATIONS

English Abstact of DE 43 31 815 A1.*

(Continued)

*Primary Examiner* — Mark Laurenzi
*Assistant Examiner* — Paul Thiede
(74) *Attorney, Agent, or Firm* — Kilpatrick Townsend & Stockton LLP; Dean W. Russell; Kristin M. Crall

(57) ABSTRACT

Embodiments provide a rotary lobe pump for conveying a fluid medium containing solids. Two rotary lobes have rotational axes that are spaced apart from each other a minimum length distance. A housing enclosing the two rotary lobes has an inlet opening and an outlet opening, each with a continuously decreasing convergence and defined lengths.

4 Claims, 4 Drawing Sheets

(58) Field of Classification Search
USPC .... 418/206, 1, 15, 180, 206.4, 206.1, 206.3; 366/102
See application file for complete search history.

(56) References Cited

U.S. PATENT DOCUMENTS

| | | | | | |
|---|---|---|---|---|---|
| 2,105,428 | A | | 1/1938 | Maglott | |
| 2,338,609 | A | | 1/1944 | Whittaker | |
| 2,540,235 | A | | 2/1951 | Berkley | |
| 3,039,398 | A | | 6/1962 | DeMichelis | |
| 3,067,687 | A | | 12/1962 | Husney | |
| 3,198,120 | A | | 8/1965 | Little, Jr. | |
| 3,746,481 | A | * | 7/1973 | Schippers | F04C 2/086 418/206.3 |
| 3,799,713 | A | * | 3/1974 | Cloots | F04C 2/086 418/206.4 |
| 4,017,222 | A | | 4/1977 | Ueno et al. | |
| 4,606,712 | A | * | 8/1986 | Vondra | 418/88 |
| 4,940,398 | A | | 7/1990 | Berges et al. | |
| 5,062,777 | A | | 11/1991 | Carlsson | |
| 5,388,974 | A | * | 2/1995 | Streiff | 418/206.4 |
| 5,439,358 | A | * | 8/1995 | Weinbrecht | 418/15 |
| 5,468,132 | A | * | 11/1995 | Snell et al. | 418/206.4 |
| 5,567,140 | A | * | 10/1996 | Dodd | 418/178 |
| 5,702,240 | A | * | 12/1997 | O'Neal et al. | 418/9 |
| 6,062,827 | A | | 5/2000 | Shu | |
| 6,095,781 | A | | 8/2000 | Petersen et al. | |
| 6,099,277 | A | | 8/2000 | Patel et al. | |
| 6,152,719 | A | * | 11/2000 | Nelik et al. | 418/201.1 |
| 6,176,693 | B1 | * | 1/2001 | Conti | 418/180 |
| 6,203,297 | B1 | | 3/2001 | Patel | |
| 6,283,740 | B1 | | 9/2001 | Brown | |
| 2004/0052670 | A1 | | 3/2004 | Dong | |
| 2007/0269325 | A1 | | 11/2007 | Candio et al. | |
| 2008/0069707 | A1 | | 3/2008 | Van Norman et al. | |
| 2009/0304540 | A1 | | 12/2009 | Whittome et al. | |
| 2011/0052436 | A1 | | 3/2011 | Krampe | |
| 2013/0202474 | A1 | | 8/2013 | Krampe | |

FOREIGN PATENT DOCUMENTS

| | | | | | |
|---|---|---|---|---|---|
| CN | 101223363 | A | | 7/2008 | |
| DE | 1553120 | | | 4/1970 | |
| DE | 2543593 | A1 | | 8/1976 | |
| DE | 4218855 | A1 | | 12/1993 | |
| DE | 4331815 | A1 | * | 3/1995 | F04D 15/0088 |
| DE | 10239558 | A1 | | 3/2004 | |
| DE | 102005017575 | A1 | | 3/2006 | |
| DE | 102007054544 | A1 | | 6/2008 | |
| DE | 202009009093 | U1 | | 11/2009 | |
| EP | 1624189 | B1 | | 2/2006 | |
| EP | 1739306 | A1 | * | 1/2007 | |
| FR | 1492841 | | | 8/1967 | |
| FR | 2239138 | | | 2/1975 | |
| GB | 856706 | | | 12/1960 | |
| GB | 901266 | | | 7/1962 | |
| GB | 1048263 | | | 11/1966 | |
| GB | 1471814 | | | 4/1977 | |
| GB | 2429751 | A | | 3/2007 | |
| JP | 5161005 | A2 | | 6/1995 | |
| JP | 2003322114 | A1 | | 11/2003 | |
| JP | 2010013951 | A | | 1/2010 | |
| WO | 8704951 | A1 | | 8/1987 | |
| WO | 9314314 | A1 | | 7/1993 | |
| WO | 2004053333 | A1 | | 6/2004 | |
| WO | 2006015766 | A1 | | 3/2006 | |
| WO | 2007026109 | A1 | | 3/2007 | |
| WO | 2009039881 | A1 | | 4/2009 | |
| WO | 2011029847 | A2 | | 3/2011 | |
| WO | 2012022784 | | | 2/2012 | |
| WO | 2012022784 | A3 | | 5/2013 | |

OTHER PUBLICATIONS

International Search Report for PCT/EP2010/063179.
International Search Report dated Mar. 6, 2013 in Application No. PCT/EP2011/064229.
Office Action dated Jul. 24, 2014 in U.S. Appl. No. 13/816,951.
China Patent Application No. 201080039875.2, dated Mar. 5, 2014, 10 pages.
U.S. Appl. No. 13/816,951, Non-Final Office Action, mailed Nov. 19, 2014, 12 pages.
U.S. Appl. No. 13/816,951, Notice of Allowance, mailed Apr. 24, 2015, 10 pages.
Chinese Patent Application No. CN201180040282.2, Office Action English translation, mailed Jan. 7, 2015, 10 pages.
European Patent Application No. EP11748632.4, Office Action, mailed Oct. 30, 2014, 8 pages.
International Patent Application No. PCT/EP2011/064229, International Preliminary Report on Patentability and English translation, issued Mar. 19, 2013, 13 pages.
Chinese Patent Application No. CN201080039875.2, Third Office Action and English translation, mailed May 6, 2015, 14 pages.
"Examination Report" Summary, JP2015011736, 1-2.
"Examination Report", JP015-011736, 1-3.

* cited by examiner

ROTARY PISTON PUMP HAVING CONVERGING INLET AND OUTLET OPENINGS FOR CONVEYING A FLUID MEDIUM CONTAINING SOLIDS

CROSS REFERENCE TO RELATED APPLICATIONS

This application is the U.S. national phase of International Application No. PCT/EP2010/063179 filed on Sep. 8, 2010, which application claims priority to German Patent Application No. DE202009012158.5 filed on Sep. 8, 2009, the contents of both of which are incorporated herein by reference.

FIELD OF THE INVENTION

The invention relates to a rotary lobe pump for conveying a fluid medium containing solids, said rotary lobe pump comprising two rotary lobes each having rotary lobe vanes engaging with other and each having a rotational axis and an outer periphery, wherein the rotational axes of the two rotary lobes are spaced apart from each other and arranged parallel to each other and wherein the outer peripheries of the two rotary lobes partially intersect each other, and further comprising a housing with an inlet opening and an outlet opening and an inner wall and an outer wall, the inner wall of the housing enclosing a respective section of the outer peripheries of the rotary lobes and wherein the rotary lobe pump is adapted to convey the medium in a feeding direction from the inlet opening to the outlet opening.

BACKGROUND

Rotary lobe pumps fall into the category of displacement pumps and have two rotary lobes each with two or more rotary lobe vanes. The rotary lobes are disposed in a housing, the inner wall of which faces the rotary lobes and the outer wall of which encloses the rotary lobe pump on the outside. With its inner wall, the housing encloses respective sections of the outer peripheries of the rotary lobes. The section enclosed by the inner housing wall is also referred to as the enclosed angle. The tips of the rotary lobe vanes may be provided with a coating, preferably a sealing face made of rubber, in order to create a seal between the rotary lobe vanes and the inner housing wall and between the rotary lobe vanes as they engage with each other. The rotary lobes are each driven rotatably about a rotational axis in respective opposite directions, an outer periphery of each rotary lobe being defined by the circular paths on which the tips of the rotary lobe vanes turn. In the region in which the rotary lobe vanes engage with each other, the two outer peripheries of the rotary lobes intersect. Rotary lobe pumps are generally symmetrical in structure in order to allow the feeding direction to be reversed.

Rotary lobe pumps with the type of construction initially specified are known, for example, from DE 297 23 984 U1, DE 34 27 282 A1, U.S. Pat. No. 2,848,952, NL 101 62 83, U.S. Pat. No. 3,126,834 and U.S. Pat. No. 15,221. Rotary lobe pumps of this kind are also used to convey media which contain solids. A fluid medium, generally a liquid which may contain various kinds and amounts of solids, is fed through the inlet opening into the region where the rotary lobes intersect and is displaced onwards to the outlet opening by the rotary lobe vanes. Media of different viscosities may be conveyed. Rotary lobe pumps of the kind initially specified have feed rates ranging, for example, from approximately 3 to 1,000 cubic meters per hour, i.e., approximately 50 to 16,667 liters per minute, and pressures of up to approximately 16 bar.

Solids contained in the medium are swept with the medium into the cavities between the rotary lobe vanes and transported with the medium in the feeding direction of the rotary lobe pump from the inlet opening to the outlet opening. Solids contained in the medium may be stones, metal parts or other foreign matter, for example.

Rotary lobe pumps are frequently deployed in challenging environments. Typical fields of application for rotary lobe pumps are, for example, sewage plants, black water and wastewater engineering, disposal and recycling engineering, the paper and cellulose industry, rail and opening operations, the food industry and the construction industry. Rotary lobe pump are used, inter alia, as sludge pumps, wastewater pumps, black water or grey water pumps, thick matter pumps, animal feed pumps, mobile pumps, pumps for media contaminated with foreign matter, liquid manure pumps, feces pumps or pumps for stillage and pulp. These deployment contexts require rotary lobe pumps to have a robust, reliable and tough design.

However, pump component damage, shut-downs and severe wear and tear are recurrent phenomena in the case of existing rotary lobe pumps, as solids are not always transported in their entirety into the cavities between the rotary lobe vanes, where they are displaced onwards, but may become trapped between the rotary lobe vanes and the housing, or between two rotary lobe vanes as they engage with each other. Solids may become stuck between rotary lobe vanes and the housing, or between two rotary lobe vanes of the two rotary lobes as they engage with each other, which may result in the pump shutting down, in damage or wear of the housing and/or of the rotary lobes, in particular of the rotary lobe vanes and in particular of any (sealing) coating on the tips of the rotary lobe vanes. Shut-downs lead to unwanted operational disruptions and damage, and wear and tear of the rotary lobes and/or the housing result in reduced efficiency of the pump due to reduced feed pressure and in higher costs due to the need for repairs and for the replacement of wearing parts and replacement parts.

In order to eliminate these disadvantages, it is proposed in DE 20 2005 010 467 U1 and in DE 20 2006 020 113 U1 held by the applicant that the housing enclose the outer peripheries of the rotary lobes beyond a housing half angle $\alpha$ of 90° on the inlet side and on the outlet side, as shown in FIG. 1. Although the above disadvantages can be decreased as a result of this reduction in the cross-section of the inlet opening and outlet opening on the inner wall of the housing, there is still a need for further improvement of rotary lobe pumps in order to prevent the disadvantages mentioned above.

BRIEF SUMMARY

The object of the present invention is therefore to provide a rotary lobe pump for conveying a fluid medium containing solids that reduces or eliminates one or more of the aforementioned disadvantages. Another object of the present invention is to provide a rotary lobe pump for conveying a fluid medium containing solids, which reduces the number of shut-downs and the wear on the rotary lobe pump and its components and/or which reduces any decrease in the efficiency or feed pressure of the rotary lobe pump even over a protracted period of operation and/or in challenging environments.

The object is achieved, according to the invention, by the outlet opening on the inner wall of the housing having a maximum discharge enlargement that is greater in a direction running parallel to the plane of the rotational axes and perpendicularly to the rotational axes than the distance between the rotational axes.

The outlet opening is an opening provided in the housing such that the outlet opening passes through both the inner wall and the outer wall of the housing. The enlargement on discharge is defined as the enlargement of the outlet opening that occurs on the inner wall of the housing, namely in a direction that is perpendicular to both rotational axes and which connects those rotational axes.

Rotary lobe pumps are often used in an operating position in which the rotational axes of the rotary lobes are horizontally oriented and are arranged vertically one above the other. In this case, the enlargement on discharge is in the vertical direction, i.e., parallel to the plane of the rotational axes and perpendicular to the rotational axes. However, other operating positions of rotary lobe pumps are also possible, for example with rotational axes which are vertically oriented and arranged horizontally adjacent to each other. In this case, the enlargement on discharge would run in the horizontal direction.

According to the invention, the enlargement on discharge is larger than the distance between the rotational axes and therefore larger than in the solutions shown in the prior art. Thus, the section of the outer peripheries that is enclosed by the inner wall of the housing is smaller in the region of the outlet opening than in the solutions shown in the prior art.

The invention is based on the realization that, on the outlet side of existing rotary lobe pumps, there is an outlet current or formation of vortices in the medium, which frequently causes solids at the outlet opening to come between the rotary lobe vanes and the housing, or between two rotary lobe vanes as they engage with each other, and which may lead to damage, wear and shut-downs. Due to the enlargement on discharge that is formed in accordance with the invention, the solids are released from the rotary lobe vanes earlier. This causes the tangential direction in which the solids are flushed out of the cavities between the rotary lobes to lead away from the opposite rotary lobe vanes. As a result, the paths of motion of the solids changes advantageously, compared to existing solutions, in such a way that the solids are guided away from the rotary lobes, in particular from rotary lobe vanes of the respective opposite rotary lobe. This change in the path of motion of the solids leads to a clear reduction in the amount of solids that, at the outlet opening, come between the rotary lobe vanes and the housing wall, or between two rotary lobe vanes engaging with each other. These advantages are manifested particularly clearly in the case of solids that have a specific weight greater than that of the medium.

This reduction in the sensitivity of the rotary lobe pump to foreign matter makes it possible, in particular, to reduce the number of shut-downs of the rotary lobe pump and the amount of wear on the rotary lobes, and to reduce any decrease in the feed pressure of the rotary lobe pump even when there is a high content of solids in the medium. The solution according to the invention also allows the service life of the rotary lobe pump to be extended and the costs for repair and maintenance of the rotary lobe pump to be reduced.

The cross-section of the enlargement on discharge may be of any shape, for example circular or oval. It is preferred that the die enlargement on discharge is larger along the entire width of the outlet opening than the distance between the rotational axes, as the positive effect on the path of motion of the solids also declines when the enlargement on discharge is less in some sections than the distance between the rotational axes. It is preferred, more specifically, that the outlet opening has a rectangular or square cross-section such that the enlargement on discharge is substantially constant across the entire width of the outlet opening.

According to the invention, the rotary lobe pump is preferably developed in such a way that the discharge enlargement is greater than an enlargement at the inner wall of the housing in a direction running parallel to the plane of the rotational axes and perpendicularly to the rotational axes. This development thus abandons the symmetrical structure of the rotary lobe pump with identically designed inlet and outlet opening, since both the reduction of the enclosed angle in the region of the outlet opening and also a larger enclosed angle in the region of the inlet opening reduce clogging with solids between the rotary lobe vanes and the housing wall or between two rotary lobe vanes engaging with each other. Since the flow conditions, and also the formation of vortices, for example, on the inlet side of the rotary lobe pump on which the medium is drawn in, are different from those on the outlet side of the rotary lobe pump, on which the medium is forced out under pressure, different shapes of the inlet opening and outlet opening, adapted to the respective pressure conditions, are also advantageous for preventing or reducing clogging with solids, not only at the inlet opening, but also at the outlet opening.

The invention is preferably developed by having the cross-section of the outlet opening taper from the inner wall of the housing to the outer wall of the housing. In this development of the invention, the cross-section of the outlet opening at the inner wall of the housing is larger than the cross-section of the outlet opening at the outer wall of the housing.

When forming the outlet opening in the housing, side faces of the outlet opening ensue between the inner and the outer wall of the housing along the periphery of the outlet opening. These side faces can also be referred to as discharge ramps. In this development of the invention, at least one of the discharge ramps is sloped in such a way that the outlet opening tapers in the feeding direction of the rotary lobe pump. Such tapering of the outlet opening in the feeding direction reduces turbulence and vortices in the region of the outlet opening. As a result, the solids are advantageously steered more strongly in paths of motion that prevent or reduce any clogging with solids between rotary lobe vanes and the housing, or between two rotary lobe vanes as they engage with each other. By shaping the discharge ramps in accordance with the invention, it is also possible, therefore, to reinforce the advantages achieved by reducing the enclosed angle.

One particularly preferred development of the invention is one in which the rotational axes of the rotary lobes are horizontally oriented and vertically arranged one above the other when the rotary lobe pump is in the operating position. In this case, the enlargement on discharge extends in the vertical direction. In such a development of the invention, it is also particularly preferred that the outlet opening has a rectangular or square cross-section, in which the lower and the upper side faces or discharge ramps slope in the feeding direction towards the middle axis of the outlet opening. The width of the outlet opening may be exactly as large at the inner wall of the housing as at the outer wall of the housing, with the result that there is no sloping of the side faces.

The invention is preferably developed by the outlet opening on the inner wall of the housing having a maximum enlargement that is greater in a direction running parallel to the plane of the rotational axes and perpendicularly to the rotational axes than the distance between the rotational axes. It is particularly preferred that the outlet opening on the inner wall of the housing has an enlargement that is less in a direction running parallel to the plane of the rotational axes and perpendicularly to the rotational axes than the distance between the rotational axes. These variants of the discharge ramps are particularly advantageous with regard to influencing the paths of motion of the solids, such that clogging with the solids between the rotary lobe vanes and the housing, or between two rotary lobe vanes engaging with each other can be prevented even more reliably.

Another preferred development of the invention is characterized by a pipe connector flange which surrounds the outlet opening and has a middle axis that is offset from a middle axis of the outlet opening at the outer wall of the housing. It is particularly preferred that the rotational axes of the rotary lobes are horizontally oriented and arranged vertically one above the other when the rotary lobe pump is in an operating position and that the middle axis of the pipe connector flange is offset vertically downwards in relation to the middle axis of the outlet opening at the outer wall of the housing.

In order that the rotary lobe pump can be connected as part of a piping system in which the pumped medium runs, the rotary lobe pump is preferably provided with a pipe connector flange. The pipe connector flange preferably has connection means to which it is possible to attach a pipe, tube or similar item to be connected. The pipe connector flange preferably surrounds the outlet opening so that the entire cross-section of the outlet opening is in fluid communication with the interior of a pipe to be connected. According to the invention, however, the pipe connector flange is preferably disposed non-concentrically with the outlet opening at the outer wall of the housing, but offset therefrom. An offset is thus produced between the outlet opening and the pipeline which is to be connected to the pipe connector flange. This offset can serve advantageously as a barrier for solids and can prevent these from being washed back into the outlet opening, or between the rotary lobe vanes and the housing, or between two rotary lobe vanes engaging with each other, after leaving the outlet opening. In this way, the sensitivity of the rotary lobe pump to foreign matter, and the costs for repair and maintenance of the rotary lobe pump can be further reduced, and the service life of the rotary lobe pump further increased.

It is advantageous, more specifically, when the lower discharge ramp of the outlet opening slopes more strongly than the upper discharge ramp, when the rotary lobe pump is in an operating position in which the rotational axes of the two rotary lobes are horizontally oriented and arranged vertically one above the other, such that a vertical offset is produced at the lower discharge ramp of the outlet opening in relation to a pipeline to be connected, i.e., that the lower discharge ramp of the outlet opening is disposed at the outer housing wall above a lower wall of a pipeline to be connected. In this way, the offset between the outlet opening and the pipeline to be connected forms an obstruction for solids that have left the outlet opening and which are located, due to force of gravity or due to currents or vortices in the medium, in the lower region of a pipeline to be connected, with the result that the solids cannot reach the outlet opening again, or only with difficulty.

The invention is preferably developed by the housing having a base frame comprising two receptacles and two flanges which can be replaceably mounted in the receptacles, one of the two flanges being embodied as the outlet flange surrounding the outlet port and the other of the two flanges is embodied as the inlet flange surrounding the inlet port. The invention is preferably also developed by the two flanges and/or the two receptacles being embodied in such a way that each of the two flanges can be mounted in the one receptacle and also in the other receptacle.

Due to the different configurations of the inlet opening and the outlet opening, an optimal feeding direction of the rotary lobe pump from the inlet opening to the outlet opening is defined. A reversed feeding direction is possible with this configuration of inlet and outlet opening, but it is disadvantageous because there is a higher risk of solids becoming jammed between the rotary lobe vanes and the housing, or between two rotary lobe vanes engaging with each other. In some applications, however, it is advantageous and desirable that the feeding direction of a rotary lobe pump can be changed, for example when media must be conveyed in different directions or in order to clear blockages. In the development according to the invention, it is therefore provided that the housing be modular in structure, comprising a base frame which has two recesses or receptacles into each of which a flange can be inserted. One flange preferably surrounds the inlet opening or the outlet opening and also, if necessary, the pipe connector flange surrounding the outlet opening. It is particularly preferred that the two flanges and/or the two receptacles have a geometry that allows each of the two flanges to be mounted in any of the two receptacles. When both flanges are detachably mountable in the receptacles, the optimal feeding direction can be reversed by swapping the two flanges. In order to ensure simple handling and thus fast and simple reversal of the feeding direction, it is particularly preferred when the flanges are mounted in the recesses by means of quick-release fasteners.

In this way, the advantages of an asymmetric configuration of inlet and outlet openings can be combined with the advantages of a reversible feeding direction.

The invention is preferably developed by the two receptacles being embodied in such a way that they mirror each other in a plane of symmetry running through the base frame. This development is particularly preferred because a mirrored configuration of the receptacles and preferably also a mirrored configuration of the external geometry of the flanges allows the flanges to be swapped in a particularly simple manner.

The invention is preferably developed by the outlet opening having at least one mobile adjuster member that can be adjusted between a first and a second position in such a way that the feeding direction when the adjuster member is in the first position is opposite the feeding direction when the adjuster member is in the second position. The invention is also preferably developed by the inlet opening having at least one mobile adjuster member that can be adjusted between a first and a second position in such a way that the feeding direction when the adjuster member is in the first position is opposite the feeding direction when the adjuster member is in the second position.

It is thus preferred in this development of the invention that the geometry of the outlet and inlet opening be variable in design, alternatively or in addition to a development of the invention with flanges that can be swappingly mounted. It is particularly preferred when the outlet opening can be modified by the at least one mobile adjuster element in such a way that it has the geometry of the inlet opening when the adjuster element is in the second position. It is also preferred when the inlet opening can be modified by the at least one mobile adjuster element in such a way that it has the geometry of the outlet opening when the adjuster element is in the second position. In this way, the feeding direction of the rotary lobe pump can be reversed by moving the adjuster element or adjuster elements from a first position to the second position. This allows the feeding direction to be reversed in a particularly simple manner, as it is not necessary to replace any components. The advantages of an asymmetric configuration of the inlet opening and outlet opening can be combined simultaneously with the advantages of a reversible feeding direction.

The invention is preferably developed by the adjuster member of the outlet opening having a pressure contact surface embodied in such a way that the adjuster member is disposed in the first position under a first pressure of the medium at the outlet opening and in the second position under a second pressure of the medium at the outlet opening, the second pressure preferably being an underpressure. Another preferred development provides a pressure sensor which is configured to detect the pressure of the medium at the outlet opening and which is coupled to the adjuster element of the outlet opening in such a way that the adjuster element is disposed in the first position under a first pressure of the medium at the outlet opening and in a second position under a second pressure of the medium at the outlet opening. The invention is also preferably developed by the adjuster member of the inlet opening having a pressure contact surface embodied in such a way that the adjuster member is disposed in the first position under a first pressure of the medium at the inlet opening and in the second position under a second pressure of the medium at the inlet opening, the second pressure preferably being an underpressure. Another preferred development provides a pressure sensor which is configured to detect the pressure of the medium at the inlet opening and which is coupled to the adjuster element of the inlet opening in such a way that the adjuster element is disposed in the second position under a first pressure of the medium at the inlet opening and in the first position under a second pressure of the medium at the inlet opening. It is particularly preferred in this regard when the pressure sensor for detecting the pressure of the medium at the inlet opening is identical to the pressure sensor for detecting the pressure of the medium at the outlet opening.

These developments according to the invention advantageously utilize the different pressures in the medium prevailing on the inlet side and the outlet side of a rotary lobe pump. On the inlet side, there is a prevailing underpressure or suction in the medium, referred to as the second pressure, whereas on the outlet side there is a prevailing positive pressure referred to as the first pressure. When the feeding direction is reversed, these pressure conditions also change accordingly. By activating the adjuster element or the adjuster elements according to these pressure conditions, it is possible to ensure that the geometry of the inlet opening and the outlet opening are adapted in a simple manner to the feeding direction. The adjuster element or the adjuster elements can be coupled to the pressure of the medium mechanically or via one or more sensors.

The invention is preferably developed by at least one of the adjuster members being coupled to at least one of the rotary lobes in such a way that the adjuster member or the adjuster members is/are disposed in the first position when the rotary lobe turns in a first direction of rotation and is/are disposed in the second position when the rotary lobe turns in a second direction of rotation.

Another way of activating the adjuster element or adjuster elements is by coupling it or them with the direction of rotation of one or both of the two rotary lobes, as provided in this development of the invention. When the feeding direction is reversed, the direction of rotation of the rotary lobes also changes, thus allowing the geometry of the inlet and outlet opening to be changed according to the direction of rotation and thus to the feeding direction when the adjuster element or adjuster elements are coupled, preferably mechanically or by sensors, to the direction of rotation.

The invention is preferably developed by at least one of the adjuster members being coupled in such a way to a switching mechanism for setting the feeding direction of the rotary lobe pump that the adjuster member or the adjuster members is/are disposed in the first position when the rotary lobe pump turns in a first feeding direction and in the second position when the rotary lobe pump turns in a second feeding direction.

Another way of activating the adjuster element or the adjuster elements is the coupling, provided in this development of the invention, to the switching device of the rotary lobe pump, with which the feeding direction can be reversed. By coupling the adjuster element or the adjuster elements mechanically or via sensors to the switch position of the switching device, the geometry of the inlet and outlet opening can be made directly dependent on the feeding direction.

BRIEF DESCRIPTION OF THE FIGURES

A preferred embodiment of the invention shall now be described with reference to the Figures, in which.

DETAILED DESCRIPTION

Figure 1:
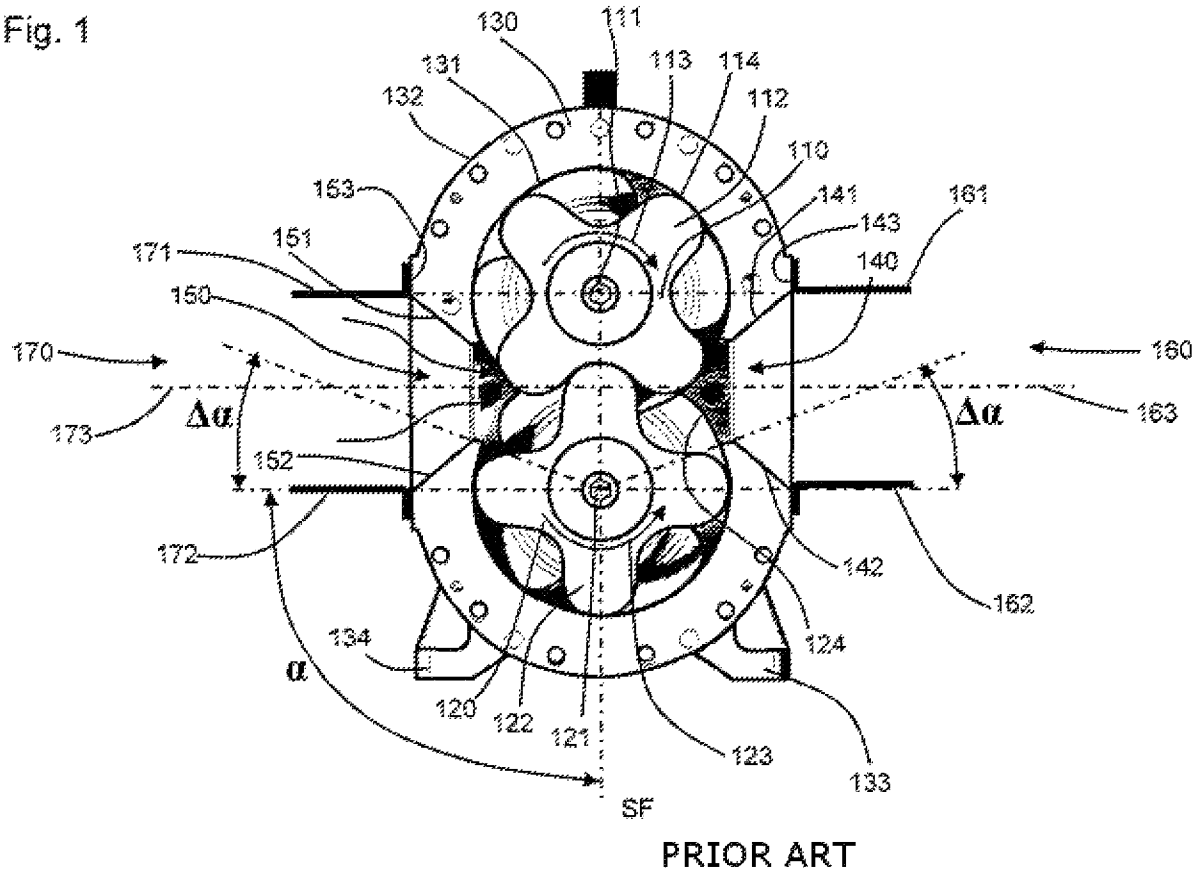
FIG. 1: shows a cross-section through a rotary lobe pump according to the prior art.

FIG. 1 shows the prior art, comprising a rotary lobe pump 100 with two rotary lobes 110, 120 and a housing 130. The two rotary lobes 110, 120 each have a rotational axis 111, 121 and four rotary lobe vanes 112, 122. Housing 130 has an inner wall 131 enclosing sections of the outer peripheries of rotary lobes 110, 120, an outer wall 132 defining the outer periphery of the rotary lobe pump and feet 133, 134. Housing 130 has one inlet opening 150 and one outlet opening 140. Outlet opening 140 is surrounded by a pipe connector flange 143 to which a pipeline 160 with an upper wall 161, a lower wall 162 and a middle axis 163 is connected. The middle axis 163 of pipeline 160 is the same as the middle axis of pipe connector flange 143. Inlet opening 150 is also surrounded by another pipe connector flange 153, to which another pipeline 170 with an upper wall 171, a lower wall 172 and a middle axis 173 is connected.

To convey a medium in the direction from inlet opening 150 to outlet opening 140, rotary lobes 110, 120 turn in the direction of rotation shown by arrows 113, 123. Inlet opening 150 and outlet opening 140 each taper towards inner wall 131 of the housing and are embodied with mirror symmetry in relation to mirror plane SF. Between inner wall 131 and outer wall 132, the inlet and outlet openings form side faces 141, 142, 151, 152.

The enclosed angle of the housing, in both the region of the inlet opening and the region of the outlet opening, is $\alpha+\Delta\alpha$, i.e., the inner wall of the housing encloses a respective section of the outer periphery of a rotary lobe of $(2\times\alpha)+(2\times\alpha\Delta)$. Such a mirror-symmetrical configuration of the inlet opening and the outlet opening is advantageous with regard to a possible switching of the feeding direction of the rotary lobe pump. However, this solution according to the prior art needs to be improved with regard to sensitivity to foreign matter, frequency of shut-downs, pressure loss, wear and tear, service life and costs of repair and maintenance.

Figure 2A:
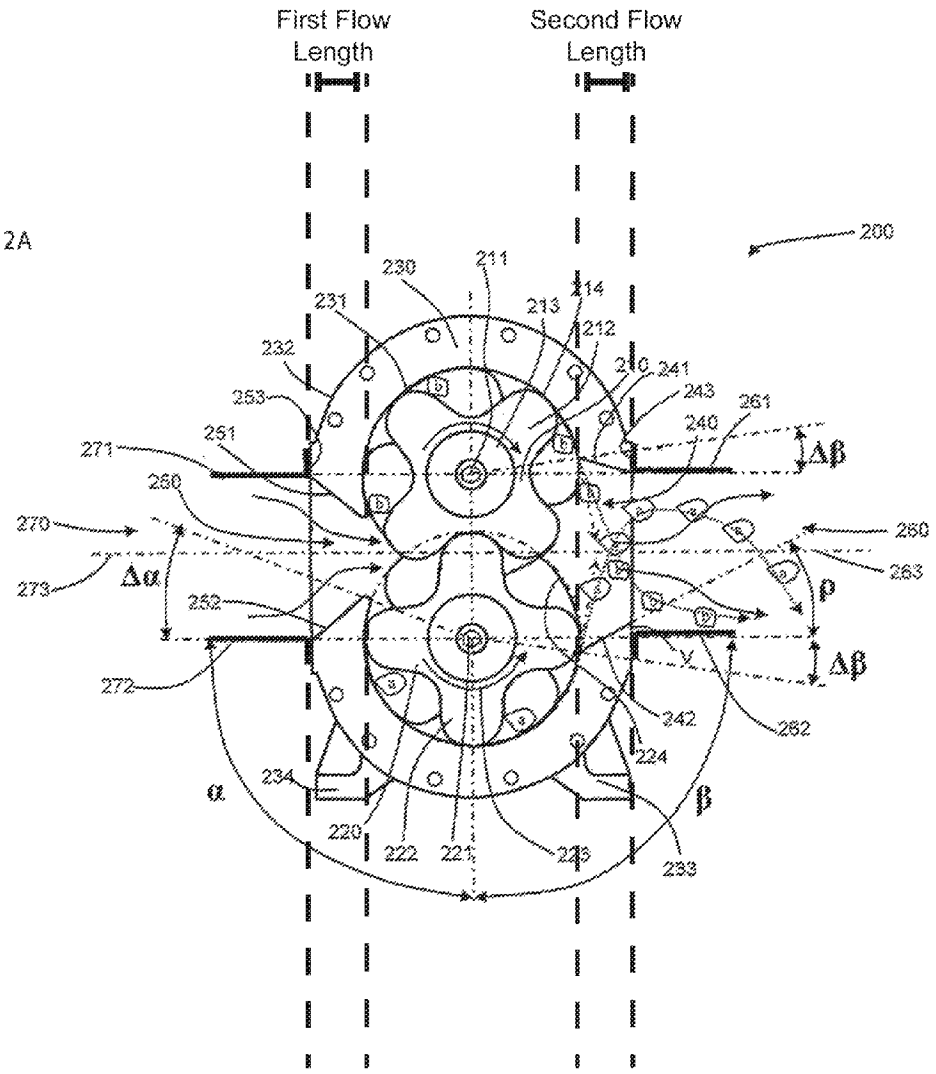
FIG. 2: shows a cross-section through a first embodiment of a rotary lobe pump according to the invention
Figure 2B:
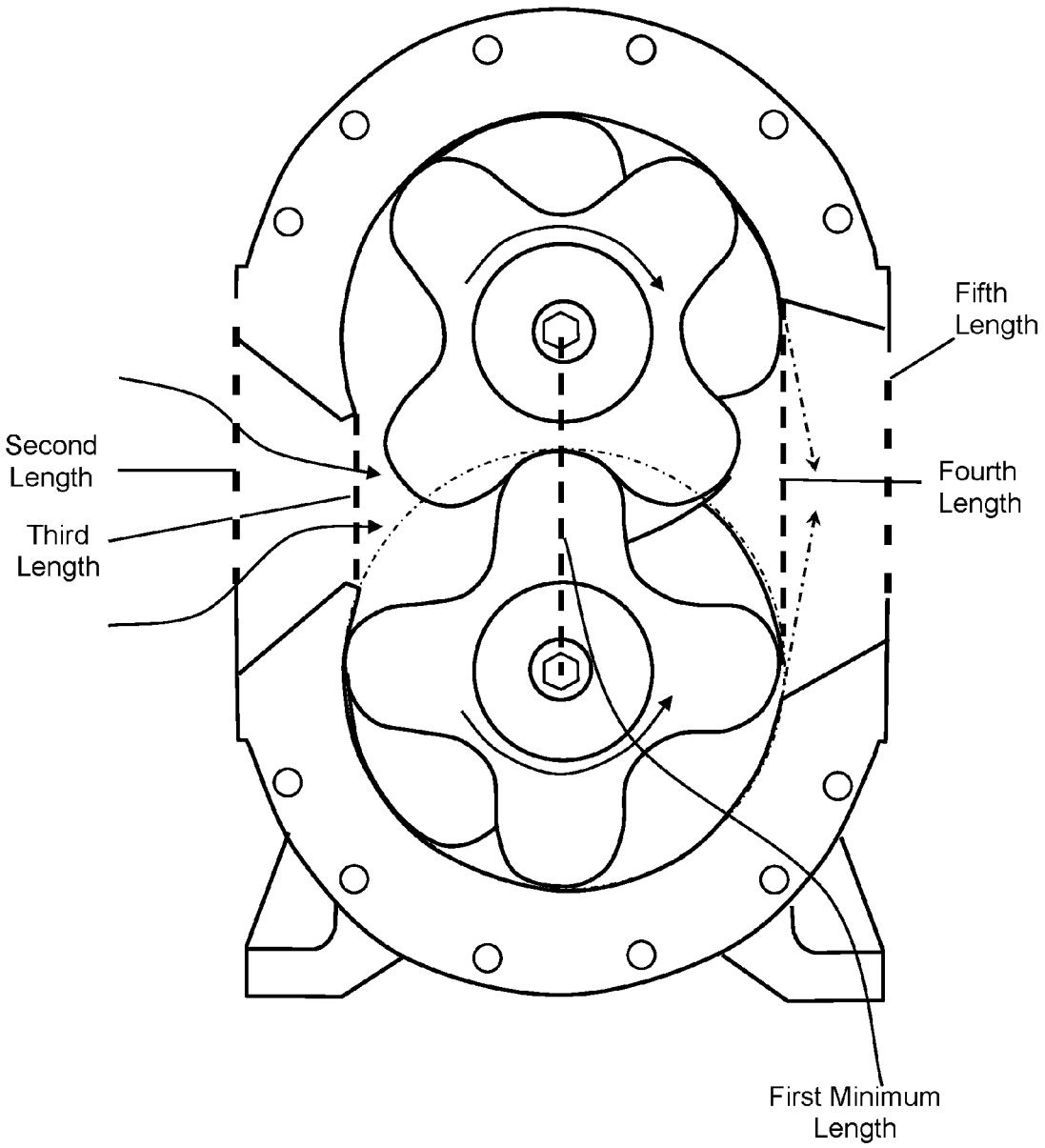
Figure 3:
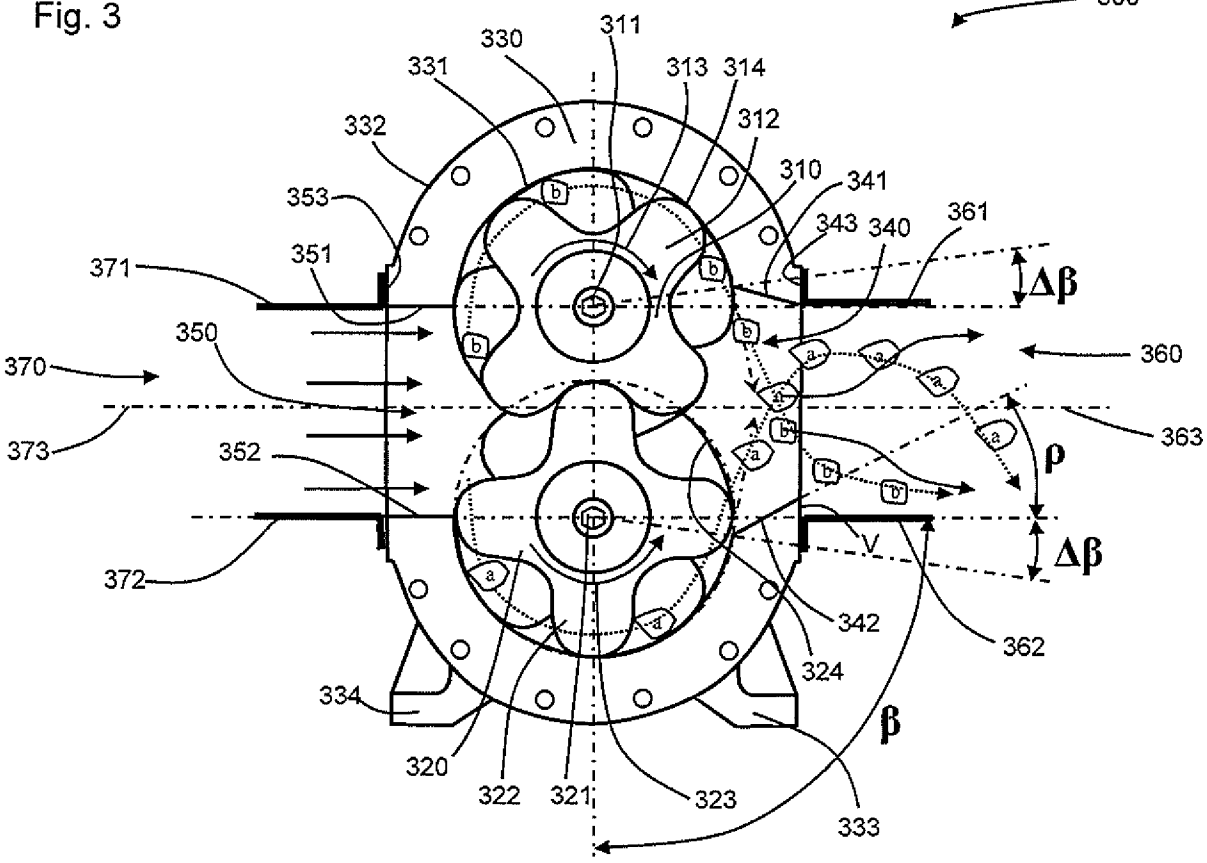
FIG. 3: shows a cross-section through a second embodiment of a rotary lobe pump according to the invention.

FIGS. 2 and 3 show two embodiments of rotary lobe pumps according to certain embodiments the invention. Components with the same or similar functions are marked with the same reference signs plus 100 (FIG. 2) and plus 200 (FIG. 3) compared to FIG. 1. In the following, the main focus is on the differences between the rotary lobe pump according to the invention, as shown in FIGS. 2 and 3, and the rotary lobe pump known from the prior art, as shown in FIG. 1, and on the differences between the two variants of the invention as shown in FIGS. 2 and 3. FIGS. 2A and 2B illustrate dimensions identifying a first flow length at the housing inlet and a second flow length at the housing outlet, as well as a first minimum length between rotational axes of the two rotary lobes. The figures also illustrate a second length at the outer surface of the inlet opening, a third length at the inner surface of the inlet opening, a fourth length at the inner surface of the outlet opening, and a fifth length at the outer surface of the outlet opening. FIG. 2 illustrates that the third length is less than the first minimum length between axes of the two rotary lobes and a fourth length at the inner surface of the outlet opening. FIG. 2 also illustrates that each of the inlet and the outlet have a continuous decreasing convergence that occurs along the entire first flow length and the second flow length.

FIGS. 2 and 3 differ from the prior art solution shown in FIG. 1 by the configuration of outlet openings 240, 340. In both the variants shown in FIGS. 2 and 3, outlet openings 240, 340 have the same design. FIGS. 2 and 3 differ in that inlet opening 250 in FIG. 2 is the same as inlet opening 150 according to the prior art in FIG. 1, whereas FIG. 3 shows an inlet opening 350 that differs not only from the prior art in FIG. 1 but also from the variant of the invention shown in FIG. 2.

The different configurations of inlet openings 250, 350 in FIGS. 2-4 is made clear, in particular, by the different inflow characteristics of the medium, as schematically represented by the arrows in the region of inlet openings 250, 350. Due to the inlet opening 250 tapering in the direction of inner wall 231 of housing 230 in FIG. 2, the medium is guided in the middle between the two rotary lobes 210, 220. In the non-tapering inlet opening 350 in FIG. 3 and FIG. 4, in contrast, the medium flows across the entire cross-section of inlet opening 350 towards a wider region of the two rotary lobes 310, 320.

In accordance with the invention, outlet openings 240, 340 in FIGS. 2-4 taper in the feeding direction, i.e. in the direction from the inner wall 231, 331 to the outer wall 232, 332 of housing 230, 330. The circular paths on which the tips of rotary lobe vanes 212, 222, 312, 322 turn define the outer peripheries 214, 224, 314, 324 of the rotary lobes, which partially intersect. The enclosed angle of inner wall 231, 331 of the housing is $\beta-\Delta\beta$ above and below the outlet side of the rotary lobe pump. The enlargement of outlet opening 240, 340 on discharge is therefore greater in a direction running parallel to the plane of rotational axes 211, 221, 311, 321 and perpendicularly to rotational axis 211, 221, 311, 321 than the distance between rotational axes 211, 221, 311, 321.

The lower side face or discharge ramp 242, 342 slopes more strongly than the upper side face 241, 241. This is realized, in the variant of the invention shown in FIGS. 2 and 3, by the upper discharge ramp 241, 341 of outlet opening 240, 340 ending at the outer wall 232, 332 of housing 230, 330 at the height of the rotational axis 211, 311 of the upper rotary lobe 210, 310, and by the lower discharge ramp 242, 342 of outlet opening 240, 340 not ending at the outer wall 232, 332 of housing 230, 330 until an angle of $\beta+\Delta\rho$ is reached. A vertical offset V thus ensues between outlet opening 240, 340 and the lower wall 262, 362 of the connected pipeline 260, 360, said offset serving as a barrier for the solids a, b. The dot-dash arrows show the tangential direction in which the solids are flushed out of the cavities between the rotary lobe vanes. These tangential directions point away from the rotary lobe vanes of the respective opposite rotary lobe. As can be seen from the dotted arrows, the paths of motion of the solids a conveyed by the lower rotary lobe 220, 320 extend in a curve from outlet opening 240, 340 into the interior of the connected pipeline 260, 360. The paths of motion of the solids b conveyed by the upper rotary lobes 210, 310 likewise extend in a curve from outlet opening 240, 340 into the interior of connected pipeline 260, 360. These paths of motion of the solids, achieved by the outlet openings being configured in accordance with the invention, substantially reduce clogging with the solids in the rotary lobe pump and thus lead to improvements with regard to sensitivity to foreign matter, frequency of shut-downs, pressure loss, wear and tear, service life and costs of repair and maintenance of the rotary lobe pump according to the invention, in comparison with the prior art.

What is claimed is:

1. A rotary lobe pump for conveying a fluid medium containing solids, comprising:

two rotary lobes, each rotary lobe of the two rotary lobes having rotary lobe vanes engaging with other and each rotary lobe having a rotational axis and an outer periphery, wherein the rotational axes of the two rotary lobes lie in a first plane and are spaced a first minimum length apart from each other in the first plane, wherein the outer peripheries of the two rotary lobes partially intersect each other, and a housing including a wall having a predetermined thickness, the wall defining an inner chamber, an inlet opening, and an outlet opening, the wall having an inner surface and an outer surface spaced apart from and opposing the inner surface, wherein the outlet opening is positioned on the wall of the housing opposite from the inlet opening across the inner chamber, the inner surface of the wall enclosing the two rotary lobes and wherein the rotary lobe pump is adapted to convey the medium in a feeding direction through the inner chamber from the inlet opening to the outlet opening in a direction transverse to the first plane, wherein the inlet opening extends through the wall between the outer surface to the inner surface and has a converging cross-section shape that decreases in the feeding direction from the outer surface to the inner surface, the inlet opening having a first flow length that spans from the outer surface to the inner surface in the feeding direction, the inlet opening further including a second length defined at the outer surface between opposing surface portions of the outer surface and a third length defined at the inner surface between opposing surface portions of the inner surface, the second length and the third length each having a respective parallel, spaced relationship with the first plane and are respectively disposed transverse to the feeding direction, wherein the inlet opening guides the fluid medium in between the two rotary lobes in the feeding direction, wherein the outlet opening extends through the wall between the inner surface and the outer surface and has a converging cross-section shape that decreases in the feeding direction from the inner surface to the outer surface, the outlet opening having a second flow length that spans from the inner surface to the outer surface in the feeding direction, the outlet opening further including a fourth length defined at the inner surface between opposing surface portions of the inner surface and a fifth length defined at the outer surface between opposing surface portions of the outer surface, the fourth length and the fifth length each having a respective parallel, spaced relationship with the first plane and are respectively disposed transverse to the feeding direction, wherein the converging cross-section of the inlet opening through the wall that decreases in the feeding direction is a continuous decreasing convergence that occurs along the entire first flow length of the inlet opening, and continuously decreasingly converges in a direction from the outer surface to the inner surface, wherein the converging cross-section of the outlet opening through the wall that decreases in the feeding direction is a continuous decreasing convergence that occurs along the entire second flow length of the outlet opening, and continuously decreasingly converges in a direction from the inner surface to the outer surface, wherein the third length of the inlet opening at the inner surface is less than each of the first minimum length between the axes of the two rotary lobes and the fourth length at the inner surface of the outlet opening, respectively, and wherein the fourth length at the inner surface of the outlet opening is greater than the first minimum length between the axes of the two rotary lobes.

2. The rotary lobe pump according to claim 1, wherein the third length of the inlet opening at the inner surface is less than the fifth length at the outer surface of the outlet opening.

3. The rotary lobe pump according to claim 1, wherein the fourth length at the inner surface of the outlet opening is greater than and the second length at the outer surface of the inlet opening.

4. A rotary lobe pump for conveying a fluid medium containing solids, comprising:

two rotary lobes, each rotary lobe of the two rotary lobes having rotary lobe vanes, wherein outer peripheries of the vanes of the two rotary lobes partially intersect each other, and a housing defining a chamber that receives the two rotary lobes therein, the housing including an inner wall and an outer wall spaced opposingly outbound from the inner wall, the inner wall being disposed so as to be adjacent the chamber and surrounding the two rotary lobes and the outer wall having an adjacent, facing relationship to an environment external to the rotary lobe pump that surrounds the outer wall, the housing further defining an inlet opening and an outlet opening, the inlet opening having a first flow length that spans from the outer wall to the inner wall, and the outlet opening having a second flow length that spans from the inner wall to the outer wall, wherein the rotary lobe pump is adapted to convey the fluid medium in a feeding direction of flow flowing through the inlet opening to the chamber containing the two rotary lobes and subsequently flowing through the outlet opening, wherein the inlet opening guides the fluid medium in between the two rotary lobes in the feeding direction of flow, and wherein both the inlet opening and the outlet opening each have a converging cross-section that decreases in the feeding direction of flow such that:

(i) the decreasing converging cross-section of the inlet opening is a continuous decreasing convergence that occurs along the entire first flow length of the inlet opening, the continuous decreasing convergence of the inlet opening converging in a direction from the outer wall to the inner wall of the housing, and (ii) the decreasing converging cross-section of the outlet opening is a continuous decreasing convergence that occurs along the entire second flow length of the outlet opening, the continuous decreasing convergence of the outlet opening converging in a direction from the inner wall to the outer wall of the housing.

* * * * *